United States Patent [19]

Loefberg

[11] Patent Number: 4,491,959

[45] Date of Patent: Jan. 1, 1985

[54] PLASTIC BAG WITH GUSSET FOLDS AND PERFORATIONS

[75] Inventor: Gustaf G. Loefberg, Landskrona, Sweden

[73] Assignee: Wavin B.V., Netherlands

[21] Appl. No.: 487,821

[22] Filed: Apr. 22, 1983

[30] Foreign Application Priority Data

Apr. 22, 1982 [NL] Netherlands ..... 8201684

[51] Int. Cl.[3] ..... B65D 27/10; B65D 33/01

[52] U.S. Cl. ..... 383/103; 383/104

[58] Field of Search ..... 383/37, 45, 104, 103, 383/121, 124

[56] References Cited

U.S. PATENT DOCUMENTS

| | | | |
|---|---|---|---|
| 3,254,828 | 6/1966 | Lerner | 383/37 |
| 3,355,303 | 11/1967 | Meyers | 383/103 |
| 3,378,189 | 4/1968 | Dickson | 383/103 |
| 3,381,886 | 5/1968 | Goglio | 383/121 |
| 3,481,461 | 12/1969 | Paxton | 383/37 |
| 4,071,187 | 1/1978 | La Fleur | 383/45 |

FOREIGN PATENT DOCUMENTS

| | | | |
|---|---|---|---|
| 111750 | 8/1964 | Czechoslovakia | 383/121 |
| 1162013 | 8/1969 | United Kingdom . | |

*Primary Examiner*—Stephen P. Garbe

*Attorney, Agent, or Firm*—Wigman & Cohen

[57] ABSTRACT

A plastic bag 1 with gusset fold parts 7, 8; 7*a*, 8*a* bounded by a central gusset fold edge 3, 3*a* and outer gusset fold edge 4, 5; 4*a*, 5*a*, is provided with a transverse seal 6 and first fold part seals 9, 10, 11, 12 at either side of the bag. Perforations 14 are present in the first and second gusset fold parts 7, 7; 7*a*, 8*a* in the area bound by said first fold part seals 9, 10, 12, 12, imaginary lines 15, 15*a* and the central gusset fold edges 3, 3*a*. The imaginary lines 15, 15*a* extend parallel to the transverse seal 6 and through the intersection of the first fold part seals and outer gusset fold edge 4, 5; 4*a*, 5*a*. Similar perforations 14 may be present at the other side of the bag in the region of the gusset fold parts bound by the central gusset fold edge 3, 3*a*, second fold part seals 16, 17, 18, 19 and imaginary lines 26, 26*a* extending parallel to the transverse seal 6 and through the intersection of second fold part seals 16, 17, 18, 19 and outer fold edges 4, 5; 4*a*, 5*a*.

5 Claims, 3 Drawing Figures

PLASTIC BAG WITH GUSSET FOLDS AND PERFORATIONS

BACKGROUND OF THE INVENTION

1. Field of the Invention

The present invention relates to a plastic bag with longitudinal gusset folds, each gusset fold comprising a central longitudinal gusset fold edge and two outer longitudinal gusset fold edges bounding a first and a second gusset fold part, at least one transverse seal extending across the width of the bag.

2. Description of the Prior Art

A plastic bag of this type has been used in the art. Filling bags of this type has the drawback that large quantities of gas from the gaseous medium as used for conveying the respective filling particles into the bag, will still be present in between said filling particles. After having filled the bag, said gas is apt to accumulate at certain points, which may give rise to a bag of an irregular shape. This is more inconvenient when bags of said type have to be stacked up to a high level.

Even in case the respective bag is provided with venting means, these drawbacks will still occur to a great extent as said venting means are provided at the filling site of the bag.

SUMMARY OF THE INVENTION

The present invention aims to provide a plastic bag of the abovementioned type not exhibiting said drawbacks in which a proper venting is always ensured, whilst on the other hand the air-permeable apertures are protected by parts of the bag, upon stacking filled bags.

This object is attained according to the invention in that air-permeable perforations which do not allow the passage of filler particles are provided in the region of the first and second gusset fold parts in such a manner that these perforations are covered by opposite outer portions of the first and second gusset fold parts joining the transverse seal in the filled condition of the bag.

Although it is known per se to provide perforations in the wall of a plastic bag to form air-permeable apertures, said perforations are directly accessible from the outer side of the known bag and are not protected in said filled bag in any manner. Covering the perforations is, however, especially important to prevent water flowing over the perforations so that moisture would be able to penetrate into a filled bag. This danger especially exists when storing filled bags under important differences of temperature between night and day, at which event dew is easily formed upon the bags.

As according to the present invention, however, the perforations are protected by first and second gusset fold parts situated between the transverse bottom seal as well as the two outer longitudinal gusset fold edges. Penetration of moisture through these perforations is thus substantially avoided.

A plastic bag according to the invention has the advantage that in an unfilled bag the air-permeable perforations are protected in the gusset folds, while in a filled bag said perforations are protected by portions of the gusset fold parts, thus ensuring an optimum protection of these perforations.

Advantageously, the perforations have dimensions comprised between 0.1 and 5 mm, more preferably 0.2 and 1.0 mm. The shape of said perforations may be arbitrary, for example, round, square or triangular.

In a more preferred embodiment, a plurality of plastic bags forms a web of plastic bags, while each individual plastic bag can be easily removd from said web of plastic bags.

The plastic bag according to the invention is particularly suitable for packing materials such as artificial fertilizers, and the like. An important advantage of the use of small perforations is that air is able to escape from the inner side of the filled bag but that moisture penetration from outside through the respective perforations, is almost impossible.

The features of the present invention which are believed to be novel are set forth with particularity in the appended claims.

Other claims and many of the attendant advantages will be more readily appreciated as the same becomes better understood by reference to the following detailed description and considered in connection with the accompanying drawings in which like reference symbols designate like parts throughout the figures.

DESCRIPTION OF THE PREFERRED EMBODIMENTS

Figure 1:
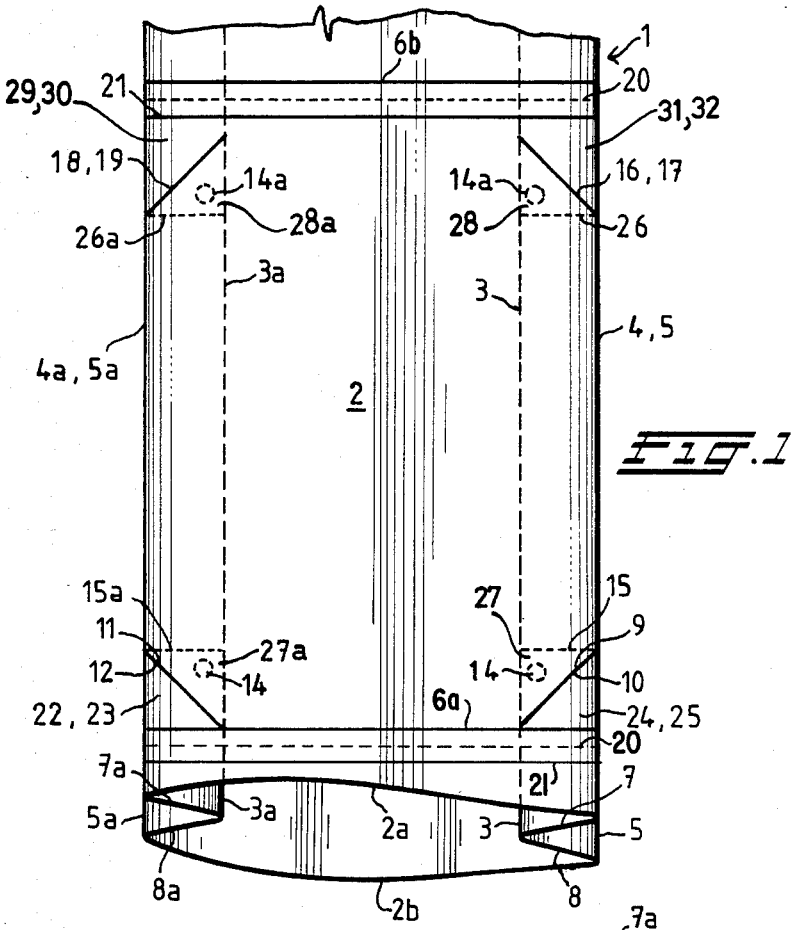
FIG. 1 is a web of plastic bags according to the invention.

Referring now to FIG. 1 a web of plastic bags comprises plastic bags 2 with longitudinal gusset folds, each gusset fold comprising a central longitudinal gusset fold edge 3 as well as two outer longitudinal gusset fold edges 4 and 5. At the other side of the bag a central longitudinal gusset fold edge 3*a* and two outer longitudinal gusset fold edges 4*a*, 5*a* are provided too.

The plastic bag is sealed off by a transverse seals 6*a* and 6*b* extending across the entire width of the plastic bag and connecting the foil layers 2*a* and 2*b* as well as the first gusset fold parts 7 and 7*a* at one side and additionally, foil layers 2*b* with second gusset fold parts 8 and 8*a* at the other side. In this manner an optimum seal is obtained.

To give a bag of this type an optimum block shape in the filled condition, first fold part seals 9, 10 are provided at one side of the bag and first fold part seals 11 and 12 at the other side of the bag. The first fold part seal 9 connects the upper foil layer 2*a* with its subjacent gusset fold part foil layer 7, whilst the first fold part seal 10 connects the subjacent foil layer 2*b* with the gusset fold part foil layer 8.

On the other hand fold part seals 11 and 12 have been formed by uniting the upper foil layer 2*a* with the subjacent lower gusset fold part foil layer 7*a* and foil layer 2*b* with the subjacent upper gusset fold part layer 8*a*.

In order to obtain a good venting capacity one or more perforations 14 are provided in the region of the inner gusset fold parts 7, 8, 7*a*, 8*a* respectively, bounded by first fold part seals 9, 10, 11, 12 central longitudinal gusset fold edges 3, 3*a* and lines 15, 15*a*. Line 15 extends across the gusset fold part 7, 8 from the central longitudinal gusset fold part 3 to the outer longitudinal gusset fold edges 4, 5.

At the other side of the bag said line 15*a* extends between the inner longitudinal gusset fold edge 3*a* and the outer longitudinal fold edges 4*a*, 5*a*. Obviously, lines 15 and 15*a* substantially extend parallel to said transverse seal 6*a*.

The plastic bags in the web of plastic bags are advantageously provided with second fold part seals 16, 17, 18 and 19. Providing another transverse seal entails that a filled plastic bag can be sealed off at that side so that likewise at that location a block shape can be given to the bag.

Wall weakenings 20 and incisions 21 allow each bag to be easily removed from the web of plastic bags and filled. Thus, through incision 21 at one side of the bag, the bag may be filled while still connected to the web. The filled bag may then be torn from the web along the wall weakening 20.

The first fold part seals 9, 10, 11, 12 respectively, diverge toward the top end of the bag whilst the second fold part seals 16, 17, 18, 19 also diverge toward the top end of the bag formed by the transverse seal 6*b*.

It is recommended that bags of this type be also provided with perforations 14 in the region of the gusset fold parts 7, 8, 7*a*, 8*a* bounded by second fold part seals 16, 17, 18, 19 and central longitudinal gusset fold edges 3, 3*a*, as well as lines 26 and 26*a* extending from the central longitudinal gusset fold edge to the outer longitudinal gusset fold edges 4, 5, 4*a*, 5*a*. Said lines 26, 26*a* extend parallel to a transverse seal 6*b* and terminate in the intersection of the second fold part seals 16, 17, 18, 19 with the outer longitudinal gusset fold edges 4, 5, 4*a*, 5*a*, respectively.

The transverse seal 6*a* is also the bottom 6*a* of the bag.

The aforesaid imaginary lines 15 and 15*a*, extend through the intersections of first fold part seals 9, 10, 11, 12 and outer edges 4, 5 and 4*a*, 5*a* respectively.

It will be obvious that in a filled condition of the bag, the perforations 14 are covered by adjacent portions 26 of a first and second gusset fold part.

In case that the first fold part seals 9, 10, 11 and 12 are omitted, perforations 14 can evidently be provided in portions 27, 27*a* of the fold parts 7, 8 and 7*a*, 8*a* respectively bounded by the central longitudinal gusset fold edge 3, 3*a* and imaginary lines replacing the first fold part seals 9, 10, 11, 12 and the imaginary lines 15, 15*a*.

In case the second fold part seals 16, 17, 18, 19 are lacking, perforations 14*a* are provided in the portions 28, 28*a* of the gusset fold parts 7, 8 and 7*a*, 8*a* respectively. After filling and closing the bag by another transverse seal, the perforations 14 are protected by other parts 29, 30, 31 and 32 of the inner gusset fold parts situated between the second fold part seals 16, 17, 18, and 19 the adjacent transverse seal and outer longitudinal gusset fold edges 4, 5, 4*a*, 5*a*.

It is essential in the bag of the present invention that the perforations 14 be present in the inner triangular part 27, 27*a*, 28, 28*a* of rectangle or square joining a transverse seals 6*a* and 6*b* and that the opposite outer triangular part 22, 23, 24, 25 of said rectangle or square covers the perforations 14 of a filled bag.

Figure 2:
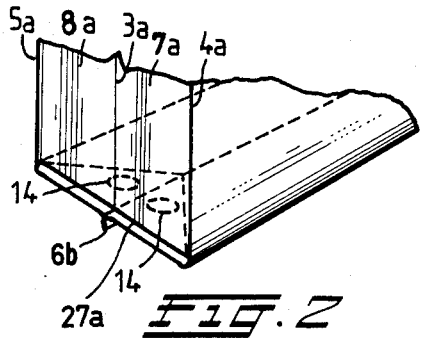
FIG. 2 is a part of a filled bag of FIG. 1.

Referring now to FIG. 2, in a perspective view of a filled bag it can clearly be seen that air-permeable perforations 14 are protected by the parts 24 and 25 of the inner gusset fold parts situated between thee fold part seals 11, 12 and the adjacent transverse seal 6*a*, as well as the outer longitudinal gusset fold edges 4*a*, 5*a* respectively.

Figure 3:
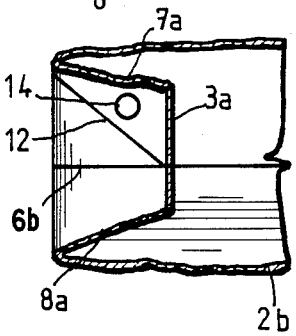
FIG. 3 is an exploded view of part of a plastic bag according to the invention.

Referring now to FIG. 3 part of the exploded upper foil layer 2*a* and the subjacent gusset fold part 7*a* are illustrated. A perforation 14 in the gusset fold part foil layer 8*a* is clearly visible.

Although the present invention has been shown and described in connection with preferred embodiments thereof, it will be apparent to those skilled in the art that many variations and modifications may be made without departing from the invention in its broader aspects. It is therefore intended to have the appended claims cover all such variations and modifications as fall within the true spirit and scope of the invention.

What is claimed is:

1. A plastic bag having first and second outer layers connected by a pair of longitudinal gusset folds, each gusset fold comprising a central longitudinal gusset fold edge and two outer longitudinal gusset fold edges bounding first and second inner gusset fold parts and at least one transverse seal, wherein air permeable perforations preventing the passage of filler particles are provided in a region of the inner gusset fold parts bounded by first fold part seals, the central longitudinal gusset fold edges, and a line extending parallel to said transverse seal and through an intersection of said first fold part seals and said outer longitudinal gusset fold edges, said first fold part seals each connecting one of said outer layers with a subadjacent gusset fold part.

2. The plastic bag according to claim 1, wherein said perforations are between 0.1 and 5 millimeters.

3. The plastic bag according to claim 1, wherein said at least one transverse seal forms a bottom for said bag; said first fold part seals diverging away from the bottom of said bag.

4. The plastic bag according to claim 3, wherein said perforations are between 0.2 and 1.0 millimeters.

5. A plastic bag having first and second outer layers connected by a pair of longitudinal gusset folds, each gusset fold comprising a central longitudinal gusset fold edge and two outer longitudinal gusset fold edges bounding first and second inner gusset fold parts and a transverse seal wherein the improvement comprises:

(a) first fold part seals each connecting one of said outer layers with a subadjacent gusset fold part, said first fold part seals diverging away from said transverse seal; and (b) air permeable perforations preventing the passage of filler particles in a region of the inner gusset fold parts bounded by said first fold part seals, said central longitudinal gusset fold edges, and a line extending parallel to said transverse seal and through an intersection of said first fold part seals and said outer longitudinal gusset fold edges.

* * * * *